US010335840B2

(12) United States Patent
Fischer et al.

(10) Patent No.: US 10,335,840 B2
(45) Date of Patent: Jul. 2, 2019

(54) PRODUCTION LINES AND METHODS FOR HOT ROLLING STEEL STRIP

(71) Applicant: THYSSENKRUPP STEEL EUROPE AG, Duisburg (DE)

(72) Inventors: Heribert Fischer, Essen (DE); Caspar Schmitt, Gelsenkirchen (DE); Andreas Zaum, Ratingen (DE)

(73) Assignee: THYSSENKRUPP STEEL EUROPE AG, Duisburg (DE)

( * ) Notice: Subject to any disclaimer, the term of this patent is extended or adjusted under 35 U.S.C. 154(b) by 270 days.

(21) Appl. No.: 14/902,812

(22) PCT Filed: Jul. 1, 2014

(86) PCT No.: PCT/EP2014/063955

§ 371 (c)(1),
(2) Date: Jan. 4, 2016

(87) PCT Pub. No.: WO2015/000895

PCT Pub. Date: Jan. 8, 2015

(65) Prior Publication Data

US 2016/0151814 A1 Jun. 2, 2016

(30) Foreign Application Priority Data

Jul. 3, 2013 (DE) ..... 10 2013 107 010

(51) Int. Cl.
*B21B 1/22* (2006.01)
*B21B 37/74* (2006.01)
(Continued)

(52) U.S. Cl.
CPC ..... *B21B 1/22* (2013.01); *B21B 37/74* (2013.01); *B21B 45/0218* (2013.01);
(Continued)

(58) Field of Classification Search
CPC ..... B21B 1/22; B21B 2001/225; B21B 45/02; B21B 45/0203; B21B 45/0209;
(Continued)

(56) References Cited

U.S. PATENT DOCUMENTS 6,030,470 A 2/2000 Hensger et al.
8,676,371 B2 * 3/2014 Botta ..... B21B 37/48 242/418

(Continued)

FOREIGN PATENT DOCUMENTS

DE 197 25 434 A1 12/1998
DE 602 06 851 T2 4/2006

(Continued)

OTHER PUBLICATIONS

Translation, EP 1038978, Sep. 2000.*

(Continued)

*Primary Examiner* — Edward T Tolan
(74) *Attorney, Agent, or Firm* — The Webb Law Firm

(57) ABSTRACT

The present disclosure relates to production lines and methods for hot rolling steel strips. Example production lines may include a hot rolling line that comprises a plurality of rolling stands through which a steel strip passes in a conveying direction. The production line may also include a cooling section for intensively cooling the steel strip as the steel strip exits a final rolling stand of the rolling line. The steel strips may be deformed so as to have a thickness of more than 15 mm and to comply with the most stringent requirements with respect to, for example, toughness. Further, at least a portion of the cooling section may overlap with a portion of the hot rolling line.

17 Claims, 3 Drawing Sheets

(51) Int. Cl.

| | |
|---|---|
| ***B21B 45/02*** | (2006.01) |
| ***C21D 8/02*** | (2006.01) |
| ***C21D 9/573*** | (2006.01) |
| ***F27D 15/02*** | (2006.01) |
| *B21B 1/26* | (2006.01) |

(52) U.S. Cl.
CPC ..... *C21D 8/0226* (2013.01); *C21D 8/0263* (2013.01); *C21D 9/573* (2013.01); *F27D 15/0206* (2013.01); *B21B 1/26* (2013.01); *B21B 2001/225* (2013.01); *C21D 8/0231* (2013.01)

(58) Field of Classification Search
CPC . B21B 45/0218; B21B 45/0233; B21B 37/74; B21B 37/76; C21D 9/0062; F27D 15/0206
See application file for complete search history.

(56) References Cited

U.S. PATENT DOCUMENTS

| | | | | |
|---|---|---|---|---|
| 2003/0168137 | A1 | 9/2003 | Chikushi et al. | |
| 2005/0115649 | A1 | 6/2005 | Tokarz | |
| 2009/0108509 | A1* | 4/2009 | Seruzawa | B21B 45/0218 266/114 |
| 2010/0163205 | A1 | 7/2010 | Seidel et al. | |
| 2012/0068391 | A1* | 3/2012 | Eto | B21B 45/0218 266/44 |
| 2013/0249150 | A1* | 9/2013 | Matsumoto | B21B 39/16 266/114 |
| 2014/0260476 | A1* | 9/2014 | Januszkiewicz | B21B 45/0251 72/45 |
| 2014/0260483 | A1* | 9/2014 | Januszkiewicz | B21B 37/74 72/201 |
| 2015/0224551 | A1* | 8/2015 | Haraguchi | B05B 1/306 72/342.2 |

FOREIGN PATENT DOCUMENTS

| | | | | | |
|---|---|---|---|---|---|
| EP | 1 038 978 | A1 | | 9/2000 | |
| EP | 2 176 010 | B1 | | 9/2012 | |
| JP | 57-112918 | A | * | 7/1982 | B21B 45/02 |
| JP | H09 141322 | A | | 6/1997 | |
| JP | 11-290932 | A | * | 10/1999 | B21B 45/02 |
| JP | H11-267730 | A | | 10/1999 | |
| JP | 2003-094101 | A | | 4/2003 | |
| JP | 2003-305502 | A | | 10/2003 | |
| JP | 2005-314811 | A | | 11/2005 | |
| JP | 2007-331017 | A | | 12/2007 | |
| JP | 2008-229684 | A | | 10/2008 | |
| JP | 2009-241113 | A | | 10/2009 | |
| JP | 2009-241114 | A | | 10/2009 | |
| JP | 2009-241115 | A | | 10/2009 | |
| JP | 2011 051002 | A | | 3/2011 | |
| JP | 2013-126676 | A | | 6/2013 | |
| KR | 10-2008-0063493 | A | | 7/2008 | |
| WO | 2009/145328 | A1 | | 12/2009 | |
| WO | 2013/030945 | A1 | | 3/2013 | |

OTHER PUBLICATIONS

Translation, JP 11-267730A, Oct. 1999.*
Chen, Liansheng, "Hot Rolled Sheet Production Technology", ISBN 7-5024-3839-4, published Mar. 1, 2006. [Cited in Chinese Office Action of corresponding application No. CN 201480038407.1. No English translation available.].
Chinese Office Action issued in corresponding application No. CN 201480038407.1, dated Oct. 16, 2017.
German Language International Search Report for International patent application No. PCT/EP2014/063955; dated Sep. 17, 2014.
English translation of International Search Report for International patent application No. PCT/EP2014/063955; dated Sep. 17, 2014.
English translation of the abstract of EP 1 038 978 A1.
English translation of the abstract of JP H09 141322 A.
English translation of the abstract of JP 2011 051002 A.
Chen Liansheng, "The technique of hot rolling sheet", Metallurgical Industry Press, (Mar. 31, 2006), ISBN: 9787502438395. [English translation unavailable].

* cited by examiner

PRODUCTION LINES AND METHODS FOR HOT ROLLING STEEL STRIP

CROSS REFERENCE TO RELATED APPLICATIONS

This application is a U.S. National Stage Entry of International Patent Application Serial Number PCT/EP2014/063955, filed Jul. 1, 2014, which claims priority to German Patent Application No. DE 102013107010.8 filed Jul. 3, 2013, the entire contents all of which are incorporated herein by reference.

FIELD

The present disclosure relates to production lines and methods for hot rolling steel strips.

BACKGROUND

A hot rolling installation of the type in question here usually comprises a hot rolling line having a plurality of rolling stands that are passed through successively in the conveying direction of the steel strip to be hot rolled, and a cooling section for intensively cooling the hot rolled steel strip exiting the final rolling stand of the rolling line.

Installations and methods of the type according to the invention are used to roll what is referred to as "heavy plate", the thickness of which is at least 15 mm. In the conventional production of such thick steel strips, the respective steel strip is rolled thermomechanically in a reversing manner in a four-high stand. However, this rolling operation lasts very much longer than hot rolling in a hot strip mill. It is therefore desirable to also hot roll thick steel strips in a conventional hot rolling installation.

The rolling of flat steel material, which is intended for the production of thick-walled pipelines which have the most stringent requirements placed on their toughness and insensitivity to crack formation, represents a particular challenge. These properties are usually assessed using the results of what is referred to as the "drop weight tear test", "DWTT" for short. The DWTT is described in provision API 5L3 of the American Petroleum Institute, 3rd Edition, February 1996, in ASTM E436, in DIN EN 10274 of 1999 and in the Stahl-Eisen-Prüfblatt (steel-iron test sheet) SEP 1326. In this test, a test body of defined weight is dropped from a likewise defined height onto a strip-shaped sheet specimen which is provided with a defined groove-like notch on its side facing away from the impacting test body, in the region of the anticipated break, and is placed with its end portions on a respective support. Here, it is generally demanded that, at a particular predetermined temperature, for example −35° C., the ductile break proportion at the thus produced break in the respective specimen is 85% on average.

Attempts have been made to optimize the toughness of thick steel strips, which are required for the production of oil or gas pipelines, by determined hot rolling and cooling strategies. Various examples of these methods are summarized for example in EP 1 038 978 B1. The method first described in EP 1 038 978 B1 itself allows cost-effective production of high-strength hot strip with excellent toughness. To this end, a precursor material, such as slabs, thin slabs or cast strip, is produced from unalloyed or low alloy steel with additions of micro-alloying elements and subsequently runs through a finishing line formed from a plurality of rolling stands. The precursor material is in this case introduced into the first rolling stand of the finishing line at a temperature which is at least 30° C. above the recrystallization stop temperature of the particular steel. Continuous hot rolling of the precursor strip to form a hot strip is then carried out in one or more passes. The hot rolling is in this case carried out in a temperature range which includes the recrystallization range of austenite. Between two rolling stands, cooling of the hot strip to a temperature which is at least 20° C. below the recrystallization stop temperature then takes place by means of a cooling device, wherein the cooling rate of the cooling is at least 10° C./s. Then, the rolling is continued below the recrystallization stop temperature at a degree of overall deformation of at least 30% in the temperature range below the recrystallization stop temperature, until the finished hot strip exits the hot rolling line.

As likewise explained in EP 1 038 978 B1, steels for the production of thick-walled pipes typically consist of an alloy in which, in addition to iron and unavoidable impurities, (in % by weight) C: ≤0.18%, Si: ≤1.5%, Mn: ≤2.5%, P: 0.005-0.1%, S: ≤0.03%, N: ≤0.02%, Cr: ≤0.5%, Cu: ≤0.5%, Ni: ≤0.5%, Mo: ≤0.5%, Al ≤2%, and up to a total of 0.3% of one or more of the elements B, Nb, Ti, V, Zr and Ca are present. These steels also include the steel grades known under the designations "X70" and "X80".

Practical experience has shown that, in spite of the measures, in each case of comparable complexity, which are required for the temperature control required in each case in the prior art, although thick hot strips with increased strength can be produced with the methods known from practice, these hot strips do not meet the requirements set in terms of toughness in the field of pipeline construction with the necessary reliability.

DETAILED DESCRIPTION

Figure 1:
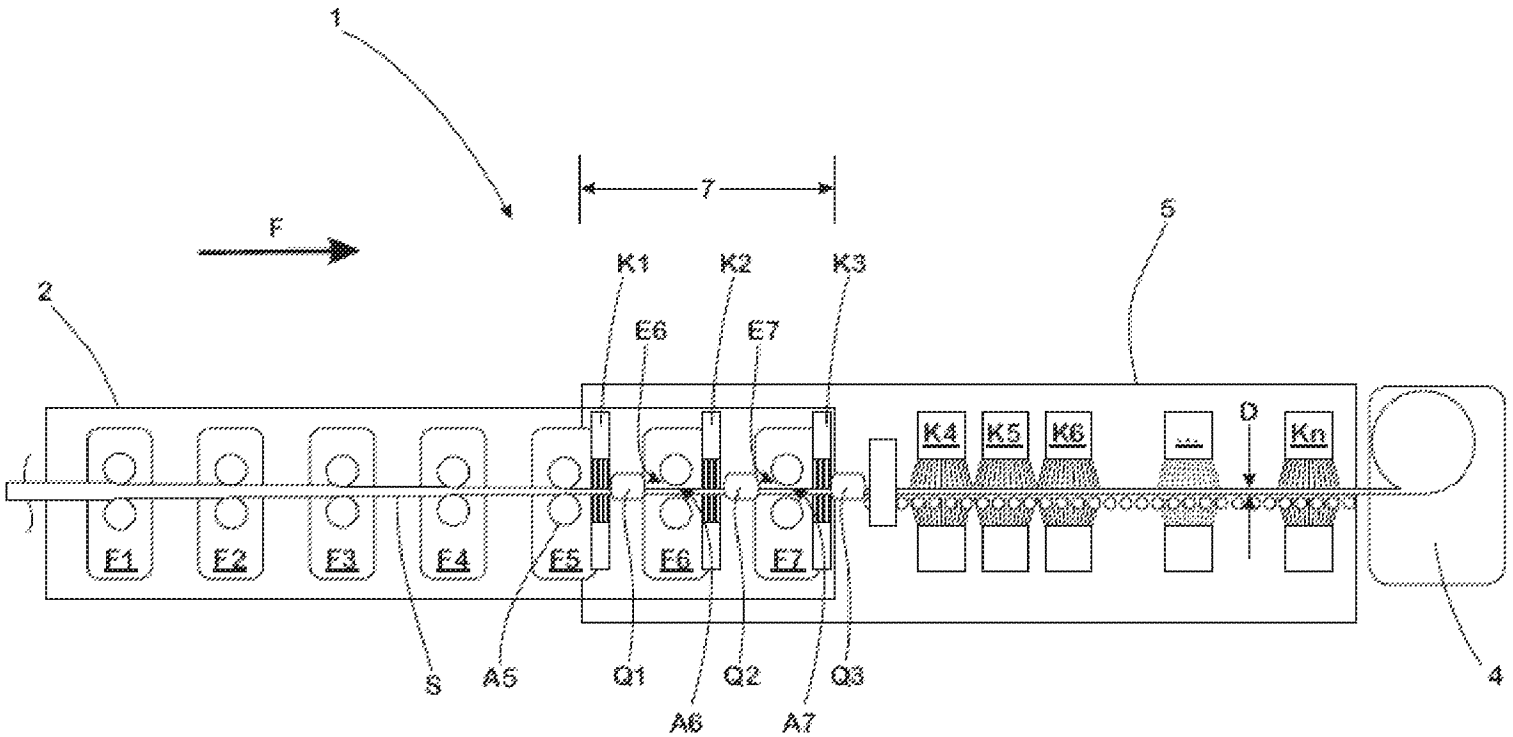
FIG. 1 is a schematic view of an example production line for hot rolling steel strips that have a final thickness of more than 15 mm, wherein the example production line employs cooling from above and below.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Against this background, the object of the invention was to create, on the basis of a conventional hot rolling installation, an installation and a method for hot rolling, with which it is possible to produce operationally reliable hot strips with a final thickness of more than 15 mm, which also comply with the most stringent requirements in terms of toughness.

Accordingly, the installation according to the invention for hot rolling steel strip comprises, in compliance with the prior art specified at the beginning, a hot rolling line which comprises a plurality of rolling stands that are passed through successively in the conveying direction of the steel strip to be hot rolled. Typically, such a hot rolling line comprises five to seven rolling stands which are arranged successively in a row in the conveying direction and are passed through successively by the steel strip to be hot rolled in each case. Likewise, in the installation according to the invention, as is usual in conventional hot rolling installations, a cooling section is provided for intensively cooling the hot rolled steel strip exiting the final rolling stand of the rolling line.

According to the invention, the cooling section does not now begin only downstream of the last rolling stand in the hot rolling line, as seen in the conveying direction of the steel strip to be hot rolled, but already before the end of the hot rolling line. Here, the start of the cooling section is set up such that the cooling section starts immediately after the final rolling stand that is actively passed through before entry into the cooling section. "Actively" means here that hot rolling still takes place in this rolling stand. By contrast, the rolling stands in which the rolling gap has been opened to such an extent by corresponding adjustment of the working rollers that the hot strip no longer undergoes any deformation on passing through the rolling stand in question are "inactive". Thus, according to the invention, on leaving the final hot rolling stand, in which hot rolling still takes place, upstream of the start of the cooling section in the conveying direction, the hot strip is struck directly by the cooling fluid output in the cooling section and is cooled in an accelerated manner.

Therefore, in a hot rolling installation according to the invention, the cooling section and the hot rolling line overlap such that the rolling line can be shortened by at least one rolling stand and the cooling section is extended into the rolling line at least to such an extent that, in the case of inactivation of one or more of the rolling stands passed through last in the conveying direction of the steel strip to be hot rolled, the cooling can take place directly downstream of the last rolling stand in which deformation still takes place.

The method according to the invention for producing rolled steel strip accordingly provides for it to be carried out on an installation configured according to the invention and for the rolling gap to be opened to such an extent during hot rolling with inactive rolling stands that no more deformation of the steel strip takes place at this rolling stand in the hot rolling line, wherein the steel strip is cooled in an accelerated manner after exiting the last active rolling stand by being subjected to a cooling fluid.

The invention is thus based on the proposal of operating a conventional multistand rolling mill such that the thickness of the steel strip is not reduced in each of the hot rolling stands passed through thereby. Instead, the steel strip is deformed only in the active rolling stands of the rolling line. In the inactive rolling stands, the rolling gap is opened to such an extent that its working rollers no longer come into contact with the rolling stock, i.e. no more deformation can take place therein. At the same time, the start of the cooling section has been shifted into the hot rolling line, and so, for example in the case of a hot rolling line with seven hot rolling stands, the accelerated cooling can already take place immediately after the fifth rolling stand and no more hot rolling takes place over the penultimate, i.e. sixth, and last, i.e. seventh, rolling stand.

This procedure is based on the finding that, when high-strength tube sheet grades having a thickness of more than 15 mm, the most stringent requirements being placed on the toughness thereof, are intended to be hot rolled in a hot rolling line in which they pass successively through the rolling stands in a continuous sequence, only a limited number of hot deformations should be carried out in order on the one hand to effect, by means of the activated rolling stands, deformation per rolling pass that is sufficient for good dimensional accuracy of the strip. On the other hand, as a result of the limited number of rolling passes with cooling that starts directly after the final deformation, the toughness transition temperature can be shifted to lower temperatures. In this way, on the basis of conventional hot rolling installations redesigned in the manner according to the invention, it is possible to produce steel sheets for pipes which are not only stronger, for example the steel grades "X70" or "X80", but also have a low transition temperature of −10° C. or less and high toughness requirements up to thicknesses of 25.4 mm.

In the production according to the invention of hot strip with a thickness of more than 18 mm, use can preferably be made of bainitic steels in order to reliably achieve the requirements to be met according to the DWTT. On account of the improvement in the transition temperatures as a result of the cooling starting according to the invention as soon as possible after the last active deformation pass, the range of application of ferritic/pearlitic steels can be expanded to greater thicknesses.

Compared with conventional cooling after the final stand in a finishing line, as a result of the early onset cooling, which extends according to the invention into the rolling line, when rolling at thicknesses of >15 mm, unimpeded ingress of oxygen and associated heavy subsequent scaling of the strip surfaces is inhibited.

During operation according to the invention of a hot rolling installation, the rolling speeds as a result of the early end of active deformation and the low degrees of overall deformation that are achieved during hot rolling are low. Typically, they are in the range of less than 3 m/s.

As a result of the extension of the cooling section into the finishing line, the possibility furthermore arises of representing cooling curves with holding times. To this end, the installation configuration merely has to be designed such that, for example when rolling in a rolling line with seven rolling stands, of which, however, only the first five are activated, spraying starts directly after the fifth stand, wherein the amount of cooling fluid output respectively upstream and downstream of the unused rolling stands is optimally settable. In conjunction with further spraying downstream of the seventh stand or/and a suitable cooling section downstream of the measuring house provided as standard in hot rolling installations of the type in question here, different holding times can be realized at desired cooling curves.

For this purpose, in a hot rolling installation according to the invention, the cooling section can comprise a plurality of cooling units and moreover a respective cooling unit can be arranged downstream, in the conveying direction, of the last rolling stand that is passed through before entry into the cooling section and of every further rolling stand that is passed through thereafter.

The cooling that takes place after the final active rolling stand is not performed by means of conventional laminar cooling, which is known from conventional hot rolling installations, but rather cooling that starts particularly quickly and has a higher cooling rate of at least 80 K/s is used. Cooling rates of at least 130 K/s have proven particularly successful here, wherein the cooling rate is typically up to 160 K/s in practice. As a result of the rapid cooling provided according to the invention, grain growth in the respectively hot rolled steel strip is limited and the low-temperature toughness of the material is increased, such that the latter reliably achieves maximum toughness values at low temperatures and accordingly has the highest mechanical properties.

In order to bring about the intensive cooling according to the invention, use can be made for example of intensive cooling systems or compact cooling units. These should be designed such that the cooling section is capable of providing a cooling fluid output of at least 1000 $m^3$/h, in particular up to 1500 $m^3$/h. In this case, cooling takes place preferably both from the top side and from the underside of the strip to be cooled, in order to ensure rapid cooling that is as uniform as possible over the strip cross section. After the respective intensive cooling, the water remaining on the hot strip can be removed by transverse high-pressure spraying, before the hot strip runs through the next inactive rolling stand and subsequently further cooling starts. This prevents water from remaining on the hot strip after each cooling stage and ensures that accordingly controlled stepwise cooling of the hot strip is achieved.

In particular compact cooling units which each output a cooling fluid jet, concentrated on a particular portion, onto the respective hot strip are suitable for the accelerated cooling that is advanced according to the invention into the rolling line. By contrast, outside the rolling line, the cooling units of the cooling section can be configured for example as conventional intensive cooling units.

With regard to the deliberately controlled manner in which the cooling is carried out according to the invention, it has been found to be optimal in this connection for the length, measured in the conveying direction of the steel strip to be hot rolled, along which the cooling unit arranged in each case downstream of one of the rolling stands within the rolling line in the conveying direction subjects the steel strip in each case to cooling fluid, to be at most 25% of the spacing at which the rolling stands of the rolling line, which are arranged in each case alongside one another, are positioned one after another in the conveying direction. In particular when the length portion, along which the output of cooling fluid takes place in each case, is limited to 8-15% of the spacing apart of the cooling units, the best working results are achieved in practice.

In this way, the cooling between the rolling stands can be carried out such that, on account of the strength of the cooling, in each case no more regulated deformation can take place in the austenitic range of the respectively processed steel. It is in this way that the cooling units that are provided according to the invention and are configured in particular as compact cooling units differ from those cooling devices which are used in conventional hot rolling mills to cool the strip to be hot rolled in each case between two rolling stands. The cooling units that are used according to the invention starting from the final active rolling stand effect such intensive strip cooling, according to the invention, that no more regulated deformation can take place in the austenitic range.

Typically, when the hot rolling method according to the invention is carried out, the initial hot rolling temperature of the steel strip is above 800° C. and below 1050° C. By contrast, the exit temperature at which the steel strip enters the cooling section on leaving the final rolling stand, via which it is hot formed, is typically between 740° C. and 900° C.

In order to develop the desired toughness properties of the steel strip hot rolled according to the invention, it may be expedient to interrupt the cooling of the steel strip at a cooling stop temperature when the steel strip has reached a cooling stop temperature of between 500° C. and 700° C. In this case, it has likewise proven advantageous, in the light of the development of the desired mechanical properties, for the steel strip to be air-cooled without active cooling for 2-12 seconds once this cooling stop temperature has been reached.

After the cooling carried out in the manner explained above, the steel strip can be coiled at a coiling temperature of between 450° C. and 650° C.

Suitable precursor products for the hot rolling according to the invention are in particular thin slabs or precursor strip with a thickness of 50-100 mm. By contrast, the final thickness of the steel strip hot rolled according to the invention is typically more than 15 mm. Tests have shown here that, using the method according to the invention, heavy plates, which are up to 25.4 mm thick and meet even the most stringent requirements in terms of their toughness in the DWTT, can be hot rolled in a continuous sequence of work steps on hot rolling installations equipped in the manner according to the invention.

The method according to the invention is suitable for relatively high-strength, micro-alloyed steels, and steels according to DIN EN 10149. The method according to the invention is particularly suitable for processing steel strips of the bainitic grades X60, X65, X70, X80 and other comparable steels which are usually used for producing heavy plates. The steels that are particularly suitable for the method according to the invention can be summarized under the general alloy specification (in % by weight) C: ≤0.18%, Si: ≤1.5%, Mn: ≤2.5%, P: 0.005-0.1%, S: ≤0.03%, N: ≤0.02%, Cr: ≤0.5%, Cu: ≤0.5%, Ni: ≤0.5%, Mo: ≤0.5%, Al ≤2%, and up to a total of 0.3% of one or more of the elements B, Nb, Ti, V, Zr and Ca, the remainder iron and unavoidable impurities.

The invention provides an installation and a method which make it possible in a versatile manner to use a conventional hot rolling installation to produce very thick hot rolled steel strip which not only has high strength values but also has optimal toughness. The steel strips produced in this way are suitable, on account of their property profile, in particular for pipeline construction. Here, a hot rolling installation designed according to the invention can be readily used for other hot rolling tasks, too. To this end, all that is necessary is for the cooling units, provided according to the invention, in the region of overlap between the cooling section and hot rolling line to be deactivated or operated such that they meet the requirements placed on cooling in conventional hot rolling.

With reference now to the figures, the installation 1 comprises a hot rolling line 2 which is formed in a conventional manner by seven rolling stands F1, F2, F3, F4, F5, F6, F7 that are positioned one after another in the conveying direction F of the steel strip S to be hot rolled in the installation 1, a roller bed 3 which follows the hot rolling line 2 in the conveying direction F, a coiling device 4 which is positioned at the end of the roller bed 3 as seen in the conveying direction F, a measuring house M which is arranged next to the end of the hot rolling line 2 in the region of the roller bed 3, and a cooling section 5. As those having ordinary skill in the art will understand, 'installations' may also be referred to as 'production lines.'

The cooling section 5 is formed by a plurality of cooling units K1, K2, K3 arranged in succession in a row in the conveying direction F and configured as compact cooling appliances, and cooling units K4, K5, K6, . . . , Kn configured as conventional, optionally as laminar cooling units, which are fed via a cooling fluid store (not shown here) and the cooling fluid output of which can be individually set in each case. The cooling fluid is in this case output in each case from below and from above onto the respectively associated underside and top side of the steel strip S by the respective cooling units K1-Kn. In order to ensure the required cooling fluid output, the cooling fluid flowing to the cooling units K1-K3 can for example be pressurized if necessary by means of pumps (likewise not shown here).

Figure 3:
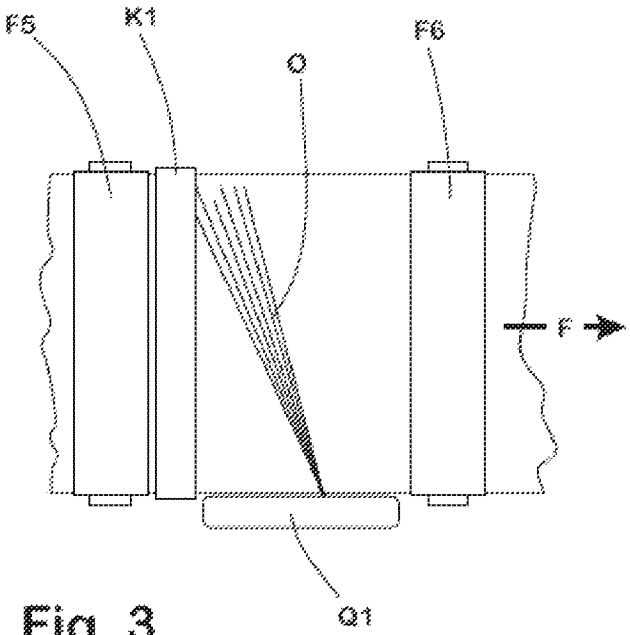
FIG. 3 is a top schematic view of the two example rolling stands shown in FIG. 2.
Figure 2:
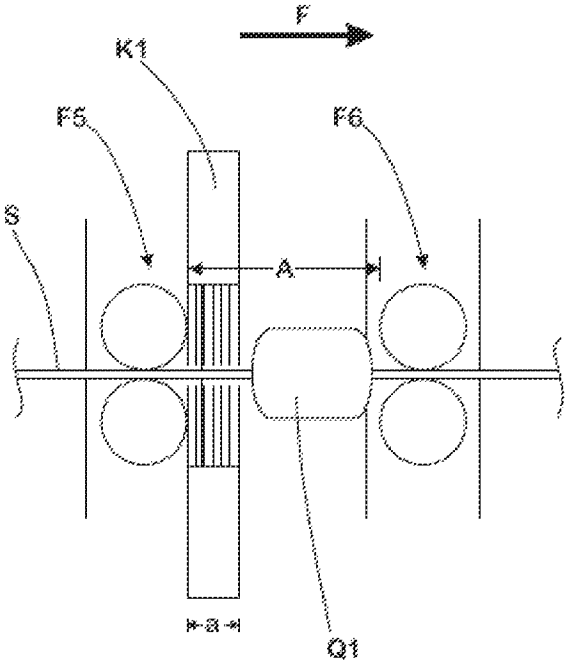
FIG. 2 is a side schematic view of two example rolling stands that can be utilized in a production line.

The first cooling unit K1, in the conveying direction F, of the cooling section 5 is arranged between the fifth rolling stand F5 and the sixth rolling stand F6 and the second cooling unit K2 of the cooling section 5 is arranged between the sixth rolling stand F6 and the seventh rolling stand F7 of the rolling line 2, such that the cooling section 5 extends into the rolling line 2 and accordingly the end portion 6 of the rolling line 2 and the starting portion 7 of the cooling section 5 overlap one another. The length portion a, along which the cooling units K1, K2 and K3 arranged in each case in the rolling line output cooling fluid onto the steel strip S, is limited in each case to about 10% of the spacing A at which, as illustrated in FIGS. 2 and 3 by way of the rolling stands F5 and F6 arranged in succession in the conveying direction F, the mutually adjacent rolling stands F1-F7 are arranged in each case.

Provided between the respective cooling unit K1 and K2 arranged in the rolling line 2 and the rolling stand F6, F7 positioned next in each case in the conveying direction F, and downstream of the cooling unit K3 provided after the rolling stand F7 is in each case a spraying device Q1, Q2, Q3, which directs a high-pressure jet O oriented transversely to the conveying direction F and in the direction of the respective cooling unit K1, K2, K3 at least onto the top side of the steel strip S, in order to drive cooling fluid remaining there off the surface in question.

In principle, it is possible, of the rolling stands F1-F7, even to deactivate rolling stands F1-F7 that are arranged farther forward in the hot rolling line 2. However, practice shows that in each case at least five of the rolling stands F1-F7 have to be active, wherein according to the invention the intensive compact cooling starts in any case after the in each case final active rolling stand in the conveying direction F, but at the latest after the final rolling stand F7 in the hot rolling line 2.

The cooling unit K1 arranged between the fifth rolling stand F5 and the sixth rolling stand F6 of the hot rolling line 2 is set up such that, as long as the cooling unit K1 is switched on, the perpendicularly downwardly directed cooling fluid jets output thereby reach as far as the exit from the rolling stand F5. In the same way, the cooling unit K2 arranged between the sixth rolling stand F6 and the seventh rolling stand F7 of the hot rolling line 2 is set up such that the cooling fluid jets output thereby reach, as long as the cooling unit K2 is switched on, as far as the exit from the rolling stand F6. Likewise, the cooling unit K3 arranged downstream of the seventh rolling stand F7 in the conveying direction F is set up such that, as long as the cooling unit K3 is switched on, the cooling fluid jets output thereby reach as far as the rolling stand F7.

In the exemplary embodiments described here, in each case at least one of the cooling units K1-K3 is in operation. In the region of the in each case inactive cooling unit, air-cooling can take place. By means of the conventional cooling units K4-Kn located downstream of the hot rolling line 2 in the conveying direction F, the hot strip is cooled to the coiling temperature HT required in each case.

The thickness of the steel slabs processed in the rolling line 2 is in practice typically in the range from 180-270 mm. Specifically, in the exemplary embodiments described here, 255-mm-thick slabs were produced from the steels E1, E2, E3 listed in table 1, said slabs running into the hot rolling line 2 at an initial hot rolling temperature WAT typically in the range from 800-1050° C. and being hot rolled there to form a respective steel strip S in a continuous sequence in the first five rolling stands F1, F2, F3, F4, F5. The thickness D of the steel strips S hot rolled from the steels E1, E2, E3 was in each case 23 mm or 18 mm, here. The initial hot rolling temperatures WAT specifically set in each case in the exemplary embodiments explained here are listed in table 3. Furthermore, the temperature TAF5 at the outlet of the fifth rolling stand F5, the temperature WET at the outlet of the finishing mill and the coiling temperature HT are likewise listed there for the respectively processed hot strip produced from the respective steel E1, E2, E3.

The steel strips S exiting the fifth rolling stand F5 likewise ran through the two final rolling stands F6 and F7 of the hot rolling line 2. However, at these rolling stands F6, F7, the working rollers had been moved so far apart that the height of the rolling gap delimited thereby was greater than the thickness D of the steel strip S exiting the fifth rolling stand F5. As a result, no more deformation of the steel strip S took place in the exemplary embodiments explained here via the two last rolling stands F6 and F7, as seen in the conveying direction F, of the rolling line 2.

Since the rolling stands F6 and F7 had been rendered inactive and thus the rolling stand F5 was the final one, in the conveying direction F, of the rolling stands F1-F7 in which hot forming of the steel strip S took place, the cooling units K1 and K2 and all of the following cooling units K3-Kn of the cooling section 5 were activated. Accordingly, after exiting the working gap A5, the steel strip S exiting the final active rolling stand F5 in the conveying direction F was struck by the cooling fluid jet of the cooling unit K1 and intensively cooled on its way to the next rolling stand F6, until it reached the entry E6 of the rolling stand F6. As soon as the steel strip S had passed through the working gap A6 of the inactive rolling stand F6, it was directly struck in the same way by the cooling fluid jet of the cooling unit K2 and likewise intensively cooled further, until it reached the entry E7 of the inactive rolling stand F7. Likewise, as soon as it had passed through the working gap A7 of the rolling stand F7, the steel strip S was struck by the cooling fluid jet of the cooling unit K3 and ran out onto the roller bed 3 on which it continued to be cooled in an accelerated and controlled manner by the further cooling units K4-Kn arranged there, until a cooling stop temperature of 500-700° C. had been reached.

When the cooling stop temperature had been reached, the active cooling was stopped and the steel strip S ran out on the roller bed 3 until it had been coiled into a coil in the coiling device 4 at a coiling temperature of 450-650° C.

At a cooling fluid pressure of more than 3 bar, specifically 3.2 bar, and a cooling fluid temperature of less than 40° C., specifically 25° C., across the cooling section 5, the cooling units K1-Kn at the cooling section 5 achieved an overall output of cooling fluid of up to 1500 $m^3/h$, specifically 1400 $m^3/h$.

In the exemplary embodiments described here, water was used as the cooling fluid. Of course, other cooling fluids can also be used in order to achieve the required cooling rate.

Figure 4:
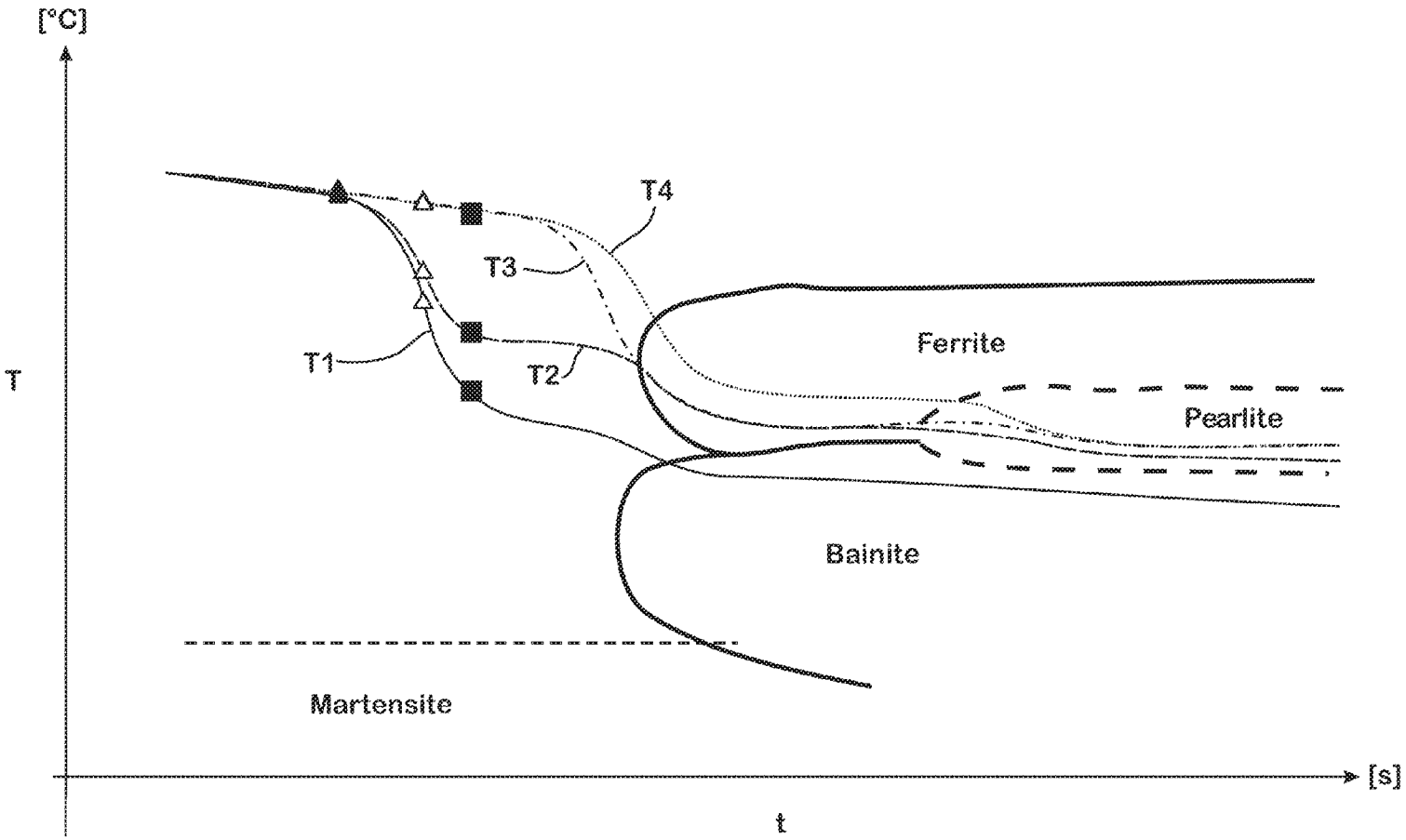
FIG. 4 is a diagram showing temperature profiles over time for cooling a plurality of steel strips using an example production line.

FIG. 4 illustrates, as a solid line T1, the temperature profile, which is achieved in the above-described mode of operation according to the invention of the installation 1, in each case for a 23-mm-thick hot strip specimen produced from the steel E1 over time t.

By comparison, the temperature profile which is achieved in the production of a 23-mm-thick hot strip specimen produced from the steel E1 when the cooling already starts in the inventive manner in the rolling line 2, but the cooling rate is lower than 80 K/s, is reproduced in FIG. 4 by way of the dashed line T2.

By contrast, the temperature profile illustrated by way of the dot-dashed line T3 in FIG. 4 is achieved in a conventional hot rolling installation which is equipped with seven rolling stands and in which the 23-mm-thick hot strip consisting of the steel E1 is air-cooled after leaving the final active rolling stand as far as after the measuring house M and is then cooled by means of compact cooling that starts only after the measuring house M.

Finally, the dotted line T4 likewise plotted in FIG. 4 illustrates the temperature profile which is achieved in a conventional hot rolling installation which is equipped with seven rolling stands and in which the hot strip is air-cooled after leaving the final active rolling stand F5 as far as the measuring house M and is cooled by means of conventional laminar cooling after the measuring house M.

Additionally, in the diagram in FIG. 4, for each temperature profile T1-T4, the respective temperature TAF5 which the hot strip has at the outlet of the final active rolling stand F5 is symbolized by solid triangles, the respective temperature TAF6 which the hot strip has at the outlet of the first inactive rolling stand F6 is symbolized by hollow triangles, the respective temperature WET which the respective steel strip S had at the end of the rolling line 2 is symbolized by a square and the respective coiling temperature is symbolized by a circle.

It can be seen that it is only in the mode of operation according to the invention that a cooling temperature profile (line T1) at which the bainitic structure required for the desired toughness is reliably achieved is set.

Each of the steel strips S produced in this way from the steels E1, E2 and E3 achieved the desired values predetermined for the respective steel with respect to strength (steel E1: Rm at least 570 MPa, Rt0.5 at least 485 MPa; steel E2: Rm at least 570 MPa, Rt0.5 at least 485 MPa; steel E3: Rm at least 625 MPa, Rt0.5 at least 555 MPa).

The average transition temperatures Tue at which there was a matt break proportion of on average more than 85%, these temperatures being determined in the DWTT for the steel strips S produced from the steels E1, E2, E3 in the above-described manner according to the invention, and the tensile strengths Rm and yield strengths Rp0.5 specifically measured in each case are listed in table 2. Thus, each of the steel strips S produced according to the invention also met the requirements placed on their toughness.

TABLE 1

| Steel | C | Si | Mn | P | S | Al | Cr | Cu | Mo | N | Ni |
|---|---|---|---|---|---|---|---|---|---|---|---|
| E1 | 0.054 | 0.297 | 1.528 | 0.014 | 0.0013 | 0.036 | 0.221 | 0.026 | 0.103 | 0.0054 | 0.2053 |
| E2 | 0.075 | 0.388 | 1.633 | 0.014 | 0.0014 | 0.032 | 0.044 | 0.023 | 0.008 | 0.0063 | 0.0296 |
| E3 | 0.046 | 0.290 | 1.690 | 0.012 | 0.001 | 0.035 | 0.280 | 0.040 | 0.110 | 0.0054 | 0.0500 |

| Steel | Nb | Ti | V | Sn | B | Ca | CEq*[1)] | PCM[2)] |
|---|---|---|---|---|---|---|---|---|
| E1 | 0.0657 | 0.0191 | 0.0006 | 0.005 | 0.0004 | 0.0012 | 0.389 | 0.165 |
| E2 | 0.0564 | 0.0044 | 0.0826 | 0.0065 | 0.0004 | 0.0007 | 0.378 | 0.184 |
| E3 | 0.0770 | 0.0130 | 0.0030 | 0.0030 | 0.0005 | 0.0011 | 0.412 | 0.167 |

Data in % by weight, remainder iron and unavoidable impurities

[1)] CEq = C + Mn/6 + (Ni + Cu)/15 + (Cr + Mo + V)/5 (according to the International Institute of Welding (I.I.W.))

[2)] PCM = C + Si/30 + (Mn + Cu + Cr)/20 + Ni/60 + Mo/15 + V/10 + 5B (according to ITO et al.: Weldability Formula of High Steels, Related to Heat-Affected Zone Cracking, Sumintomo Search, 1(1969), H. 5, p. 59-70)

TABLE 2

| Steel | Steel strip thickness [mm] | Tue [° C.] | Rp0.5 [MPa] | Rm [MPa] | Matt break proportion [%] |
|---|---|---|---|---|---|
| E1 | 18 | −20 | 530 | 630 | >90 |
| E1 | 23 | 0 | 530 | 630 | >85 |
| E2 | 18 | −10 | 530 | 630 | >85 |
| E3 | 18 | −20 | 650 | 650 | >87 |

TABLE 3

| Steel | Steel strip thickness [mm] | WAT [° C.] | TAF5 [° C.] | WET [° C.] | HT [° C.] |
|---|---|---|---|---|---|
| E1 | 18 | 900 | 820 | 730 | 550 |
| E1 | 23 | 880 | 820 | 700 | 550 |
| E2 | 18 | 900 | 820 | 730 | 550 |
| E3 | 18 | 880 | 820 | 730 | 550 |

What is claimed is:

1. A production line for hot rolling a steel strip, the production line comprising:

a hot rolling line having a plurality of rolling stands, the plurality of rolling stands comprising, a plurality of successive active rolling stands disposed at an upstream end of the hot rolling line, and at least one inactive rolling stand disposed downstream of the plurality of active rolling stands in a conveying direction of the steel strip to be hot rolled, the hot rolling line is configured to hot roll the steel strip by passing the steel strip successively through the plurality of rolling stands in the conveying direction; and a cooling section configured to cool the hot rolled steel strip after exiting a last of the active rolling stands, the cooling section having an upstream end positioned to start after the last of the active rolling stands and before the at least one inactive rolling stand such that at least a portion of the cooling section is shifted to be located upstream of the at least one inactive rolling stand of the hot rolling line, the cooling section comprising at least, a first cooling unit disposed at the upstream end of the cooling section and positioned between the last of the active rolling stands and the at least one inactive rolling stand, and a second cooling unit disposed downstream of the at least one inactive rolling stand, wherein the first cooling unit subjects the steel strip to cooling fluid along a length of the steel strip measured with respect to the conveying direction that is at most 25% of a distance between the last of the active rolling stands and the at least one inactive rolling stand.

2. The production line of claim 1, wherein the hot rolling line further comprises a plurality of successive inactive rolling stands disposed downstream of the plurality of active rolling stands in the conveying direction, and the cooling section further comprises a plurality of cooling units including the first and second cooling units, wherein at least one of the plurality of cooling units is disposed between two successive inactive rolling stands of the plurality of inactive rolling stands.

3. The production line of claim 2 wherein at least one cooling unit is disposed in a portion of the cooling section that is disposed downstream of a last of the plurality of inactive rolling stands.

4. The production line of claim 2 wherein each of the plurality of cooling units in the cooling section are independently controllable.

5. The production line of claim 2 wherein at least one of the plurality of cooling units disposed in a portion of the cooling section that is upstream of at least one inactive rolling stand of the hot rolling line is configured as a compact cooling unit.

6. The production line of claim 5, further comprising a spraying device positioned downstream of the first cooling unit wherein the spraying device is configured to direct a liquid jet onto the steel strip to drive the cooling fluid off the steel strip before the steel strip enters a first inactive roll stand in the conveying direction of the plurality of roll stands and/or a spraying device positioned downstream of at least one of the plurality of cooling units disposed between one of the plurality of inactive rolling stands of the plurality of inactive rolling stands and the next successive inactive rolling stand of the plurality of inactive rolling stands in the conveying direction, wherein the spraying device is configured to direct a liquid jet onto the steel strip to drive the cooling fluid off the steel strip before the steel strip enters the successive inactive rolling stand.

7. The production line of claim 1 wherein the cooling section has a total cooling fluid output of at least 1000 $m^3$/h.

8. A method for hot rolling a steel strip, the method comprising:

hot rolling the steel strip in a hot rolling line by passing the steel strip through a plurality of rolling stands in a conveying direction, the plurality of rolling stands including a plurality of active rolling stands followed by at least one inactive rolling stand, the hot rolling step including, first passing the steel strip through the plurality of active rolling stands such that the active rolling stands contact and deform the steel strip passing there through, and next passing the hot roll deformed steel strip through the at least one inactive rolling stand, wherein a rolling gap of working rollers of the inactive rolling stand are opened to such an extent that the working rollers do not contact the deformed steel strip, and thereby do not further deform the steel strip;

cooling the steel strip in a cooling section, wherein the cooling section has an upstream end that starts after a last of the active rolling stands and before the at least one inactive rolling stand such that at least a portion of the cooling section is shifted to be located upstream of the at least one inactive rolling stand of the hot rolling line, the cooling section comprises a first cooling unit disposed at the upstream end of the cooling section and positioned between the last of the active rolling stands and the at least one inactive rolling stand and a second cooling unit disposed downstream of the at least one inactive rolling stand, and the first cooling unit subjects the steel strip to cooling fluid along a length of the steel strip measured with respect to the conveying direction that is at most 25% of a distance between the last of the active rolling stands and the at least one inactive rolling stand, wherein the steel strip is cooled at a rate of at least 80 K/s after the steel strip exits a last of the plurality of active rolling stands that deforms the steel strip.

9. The method of claim 8 wherein hot rolling the steel strip comprises deforming the steel strip to have a thickness of at least 15 mm at a point where the steel strip exits the hot rolling line.

10. The method of claim 8 wherein the steel strip passes through the at least one inactive rolling stand at a speed of less than 3 m/s.

11. The method of claim 8 further comprising heating the steel strip to a temperature of between 800 and 1050 degrees Celsius prior to hot rolling.

12. The method of claim 8 wherein the steel strip is at a temperature of between 740 and 900 degrees Celsius when the steel strip leaves a last of the active rolling stands in the conveying direction and enters the cooling section.

13. The method of claim 8 wherein cooling of the steel strip is stopped at a cooling-stop temperature of between 500 and 700 degrees Celsius.

14. The method of claim 13 further comprising maintaining the steel strip at the cooling-stop temperature for 2 to 12 seconds after the steel strip reaches the cooling-stop temperature.

15. The method of claim 8 further comprising coiling the steel strip at a coiling temperature of between 450 and 650 degrees Celsius.

16. The method of claim 8 wherein a thickness of the steel strip upon entering the hot rolling line is between 50 and 100 mm, and wherein the thickness of the steel strip is between 15 and 25.5 mm upon exiting the hot rolling line.

17. The method of claim 8 wherein the steel strip comprises iron, impurities, and in percentage by weight less than or equal to 0.18% C, less than or equal to 1.5% Si, less than or equal to 2.5% Mn, 0.005-0.1% P, less than or equal to 0.03% S, less than or equal to 0.02% N, less than or equal to 0.5% Cr, less than or equal to 0.5% Cu, less than or equal to 0.5% Ni, less than or equal to 0.5% Mo, less than or equal to 2% Al, and up to a total of 0.3% of one or more of elements B, Nb, Ti, V, Zr, or Ca.

* * * * *